US005195708A

United States Patent [19]

Marsh

[11] Patent Number: 5,195,708

[45] Date of Patent: Mar. 23, 1993

[54] SUPPORT BRACKET

[75] Inventor: Thomas R. Marsh, Winston-Salem, N.C.

[73] Assignee: Tenn-Tex Plastics, Inc., Wallburg, N.C.

[21] Appl. No.: 837,215

[22] Filed: Feb. 18, 1992

[51] Int. Cl.[5] ..... A47G 29/02

[52] U.S. Cl. ..... 248/250; 108/108; 211/90

[58] Field of Search ..... 248/239, 250, 243, 235, 248/241; 108/107, 108, 109; 211/187, 186, 153, 90

[56] References Cited

U.S. PATENT DOCUMENTS

| | | | |
|---|---|---|---|
| 3,471,112 | 10/1969 | MacDonald et al. | 248/239 |
| 4,037,813 | 7/1977 | Loui et al. | 248/250 |
| 4,053,132 | 10/1977 | Del Pazzo | 248/250 X |
| 4,666,117 | 5/1987 | Taft | 248/243 |
| 4,691,887 | 9/1987 | Besinger | 248/250 |
| 4,732,358 | 3/1988 | Hughes et al. | 248/250 X |
| 4,830,323 | 5/1989 | Harley | 248/250 |
| 4,856,746 | 8/1989 | Wrobel et al. | 248/239 X |
| 4,909,465 | 3/1990 | Lyman | 248/250 |
| 5,080,311 | 1/1992 | Engstrom | 248/250 |

FOREIGN PATENT DOCUMENTS 1540224 3/1979 United Kingdom .

*Primary Examiner*—Carl D. Friedman
*Assistant Examiner*—Korie H. Chan
*Attorney, Agent, or Firm*—Bell, Seltzer, Park & Gibson

[57] ABSTRACT

A support bracket for attaching a shelf to walls includes a substantially planar body having upper and lower body portions. The upper body portion includes a pair of substantially parallel lateral edges extending upward from the lower body portion and coplanar therewith. A support projects forward from the lower body portion for supporting the edge of a shelf. A flexural plate is attached to each parallel, lateral edge and has an inner edge and a lower shelf engaging edge. Each extends forwardly and inwardly from the lateral edge toward a medial portion of the upper body portion to form a gap between the inner edges of the plates. A flexible sheet hinge is attached to the flexural plates and extending along the inner and upper edges of the plates. The inner edges of the shelves move toward each other and the plates flatten into a more coplanar configuration with the body member and the flexural plates return to their original orientation as the upper edge of the shelf passed the lower shelf engaging edges.

19 Claims, 2 Drawing Sheets

SUPPORT BRACKET

FIELD OF THE INVENTION

This invention relates to a support bracket for attaching a shelf to walls.

BACKGROUND OF THE INVENTION

In cabinets, cases, and other similar structures, brackets or other shelf supports are used for attaching the shelf to the walls inside the structure. Many of brackets include a planar body member formed of injection molded material having a post which is inserted into a receiving hole inside the cabinet for retaining the bracket thereto. The shelf usually rests on a ledge extending horizontally from the planar body member.

Some support brackets include a locking mechanism for retaining the shelf to the bracket when the bracket is in place. For example, U.S. Pat. No. 4,666,117 discloses a shelf lock having a planar body member formed of two integral halves joined together at an angle and forming a rectangular opening. A crescent shaped planar protrusion is positioned over the opening and has a lower shelf engaging edge for retaining the shelf in position on the ledge. The shelf is locked into position by sliding the shelf over the protrusion, depressing the protrusion and allowing the shelf edge to move onto the ledge. Afterward, the protrusion springs back to where the lower shelf engaging edge is locked over the shelf.

When the shelf engaging edge is biased rearwardly, it tends to pivot away from the top of the shelf about an undefined point above the ledge. The angled upper half of the body counters this problem and provides a second pivoting movement of the upper half to counteract the pivotal movement of the shelf engaging edge. However, the thickness of the shelf must be to within a strict tolerance for the movement pivoting motion to work.

U.S. Pat. No. 4,830,323 discloses a shelf support in which a shelf engaging edge moves perpendicular to the body portion when returning to its original position once the shelf edge has been inserted. Thus, the shelf and support may have greater clearance. The structure includes two flexible limbs extending upwardly from the body portion. A V-shaped upper portion is positioned on the limbs.

The lower edge of the V-shaped upper portion defines a shelf engaging edge which engages the top portion of the shelf when it is slid into position onto a ledge extending forwardly from the body portion. As the shelf moves over the V-shaped upper portion, the limbs twist and are forced apart to accommodate flattening of the V-shaped portion. When the shelf is positioned over the ledge, the limbs twist back into their prone position in which the shelf engaging edge is positioned over the shelf to retain the shelf in position. Although this structure allows clearance between the shelf engaging edge and the ledge, the structure is not as rigid as desired because the limbs must be designed flexible enough to allow them to twist and be forced apart. When the structure is injection molded as a one-piece unit, the structure is inherently weaker because the unit must be designed flexible enough to allow the arms to twist apart as the shelf moves over the protrusion.

SUMMARY OF THE INVENTION

It is therefore an object of the present invention to provide a support bracket for attaching a shelf to walls and in which a body portion has high structural strength and in which flexural plates defining a lower shelf engaging edge are movable during shelf insertion without pivoting or outward movement of an upper body portion of the support bracket.

A support bracket for attaching a shelf to walls is disclosed. The bracket includes a substantially planar body having upper and lower body portions formed preferably from a polymeric material. The upper body portion includes a pair of substantially parallel lateral edges extending upward from the lower body portion and coplanar therewith. Means is connected to the body for securing the body member to a wall. A support projects forward from the lower body portion opposite the wall securing means for supporting the edge of a shelf.

A flexural plate is attached to each parallel, lateral edge and includes an inner edge and a lower shelf engaging edge. Each plate is dimensioned and configured substantially similar to each other and extends forwardly and inwardly from the lateral edge toward a medial portion of the upper body portion to form a gap between the inner edges of the plates that is almost about one-half the width across a plate. Upon pressure from a shelf edge lowered onto the upper edges of the flexural plates, the inner edges of the flexural plates move toward each other and the plates flatten into a more coplanar configuration with the body member. The flexural plates return to their original orientation as the upper edge of the shelf passes the lower shelf engaging edges.

The flexural plates are resiliently connected to the lateral edges. A flexible sheet hinge is resiliently connected to and extends between the inner edges. The flexible sheet hinge has a profile chosen from the group comprising V-shaped, semicircular, semihexagonal, semioctagonal and arcuate. Each of the flexural plates includes an upper edge and the flexible sheet hinge is connected to the upper edges and extends rearward and upward. The lateral edges remain substantially vertical during shelf insertion.

The lateral edges are defined preferably by substantially rigid arm members extending upward from the lower body portion and are coplanar therewith. Each plate has an inner edge, a lower shelf engaging edge, and an upper edge tapered rearward and upward from the inner edge to the arm member. The flexural plates are configured preferably in a trapezoid.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION

Figure 1:
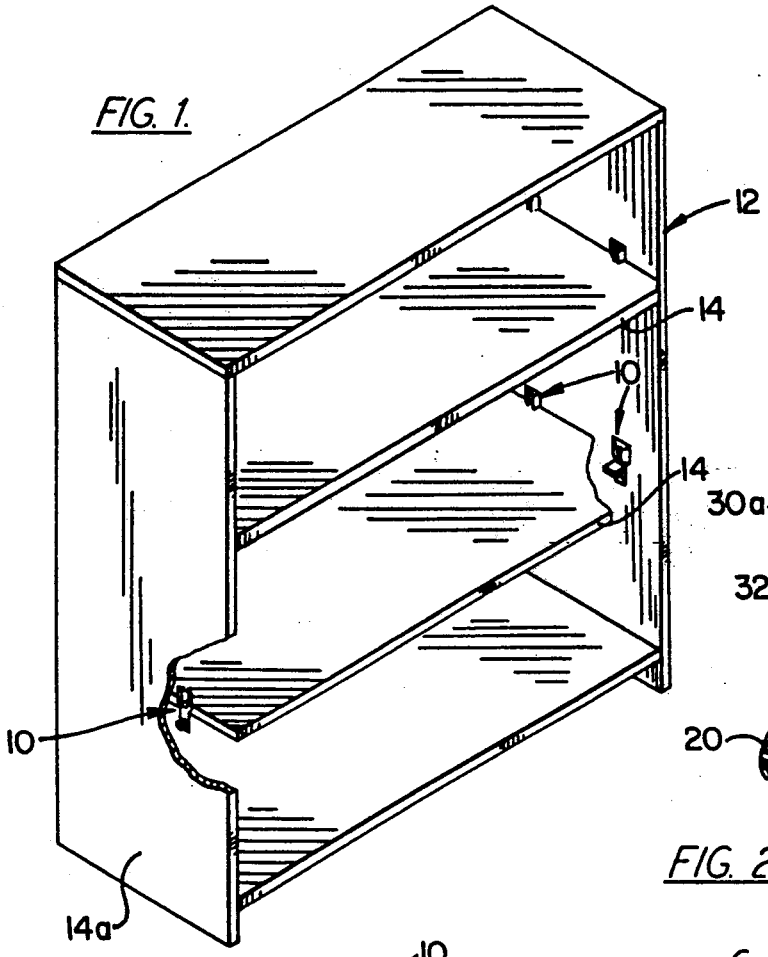
FIG. 1 is a perspective view of a bookshelf showing the support brackets of the present invention supporting shelves.

Referring now to FIG. 1, the support bracket in accordance with the present invention, indicated generally at 10, is secured to the walls of a book shelf 12 and secures the shelves 14 to the walls.

Figure 2:
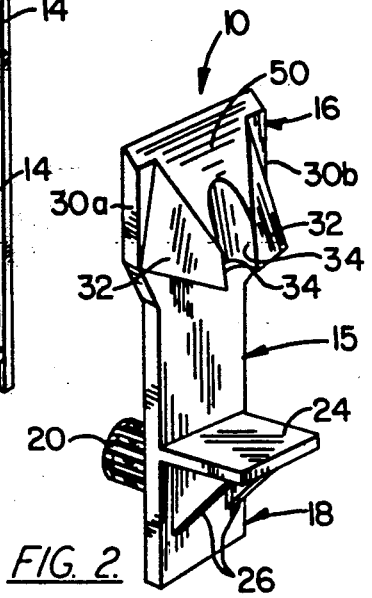
FIG. 2 is a perspective view of the support bracket in accordance with the present invention.
Figure 3:
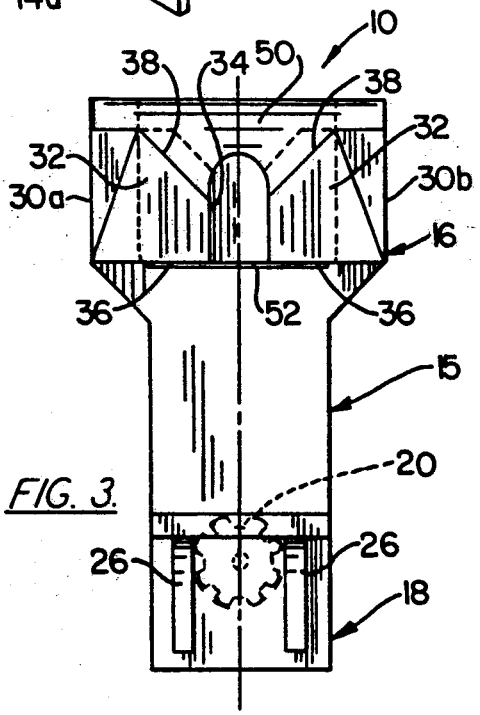
FIG. 3 is a front elevation view of the support bracket.
Figure 5:
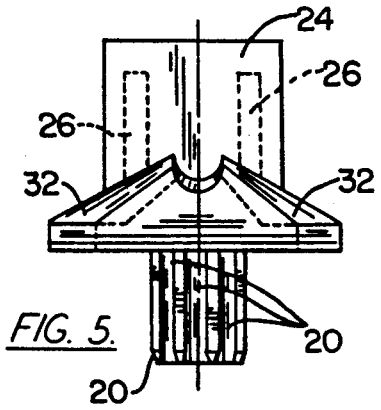
FIG. 5 is a plan view of the support bracket.
Figure 6:
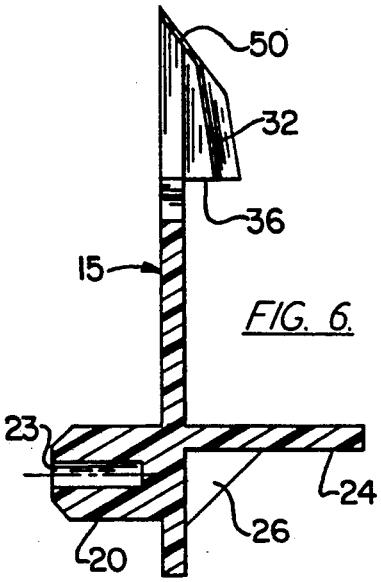
FIG. 6 is a sectional view of the support bracket taken along line 6—6 of FIG. 5.

The support bracket 10 includes a substantially planar body 15 having upper and lower body portions 16, 18 (FIGS. 2 and 3). The body 15 can be formed from various molding techniques, most notably, injection molding. A longitudinally ribbed, barrel shaped post 20 projects rearward from the lower body portion and is adapted to be inserted within holes positioned in the wall of a cabinet or other structure, for securing the body 15 to the wall. As shown in FIG. 5, flutes 22 extend along the post 20 to aid in securing the body to the wall. The post 20 includes a bore 23 extending inward to form a hollow cylinder (FIG. 6).

On the opposite face of the lower body portion 18 opposite the post 20, a shelf support 24 formed integral with the lower body portion projects outward for supporting the edge of a shelf. Two support braces 26 strengthen the shelf support 24 to withstand greater downward forces projected against the shelf support 24.

The upper body portion 16 includes a pair of substantially rigid support arm members 30 extending upward from the lower body portion and defining a pair of substantially parallel lateral edges 30*a*, 30*b*. A plate 32 is flexibly connected to each arm member 30. Each plate 32 has an inner edge 34, a lower shelf engaging edge 36, and an upper edge 38, which is tapered rearward and upward from the inner edge to the arm member 30. Each plate 32 extends forwardly from the arm members 30 toward a medial portion of the upper body portion 16 to form a gap between the inner edges 34 of the plate. Each plate 32 is of substantially similar configuration to the other plate. The formed gap between the inner edges 34 of the plates 32 is about one half the width across a plate. In the illustrated embodiment, each of the flexural plates 32 is configured in a trapezoid.

Figure 4:
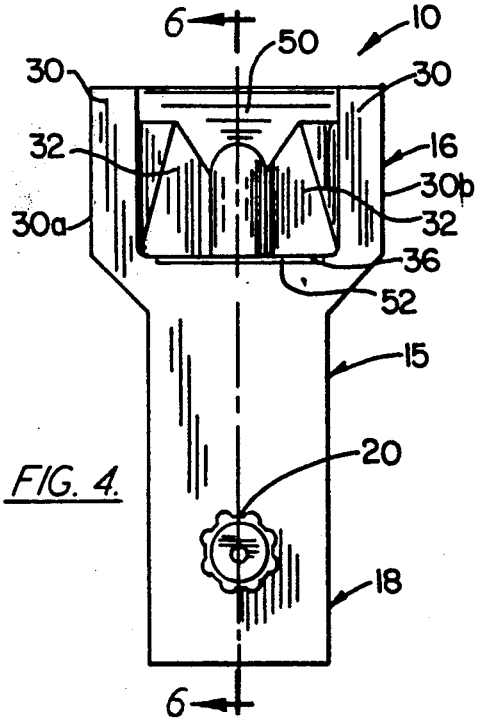
FIG. 4 is a rear view of the support bracket.

As shown in FIG. 2, a flexible sheet hinge is inwardly attached to the flexural plate 32 along the inner and upper edges 34, 36 of the plate 32, and attaches to the support arm members 30 at their top portion. The portion of the flexible sheet hinge 50 connecting the inner edges 34 and a portion of the upper edges 38 has a semicircular profile (FIG. 5). However, the profile of the sheet hinge 50 also can be V-shaped, semihexagonal, semioctagonal and arcuate. A rectangular configured cut-out 52 is positioned below the lower shelf engaging edge 36. The height of the cut-out 52 is small compared to its width, as shown in FIGS. 3 and 4.

Figure 7A:
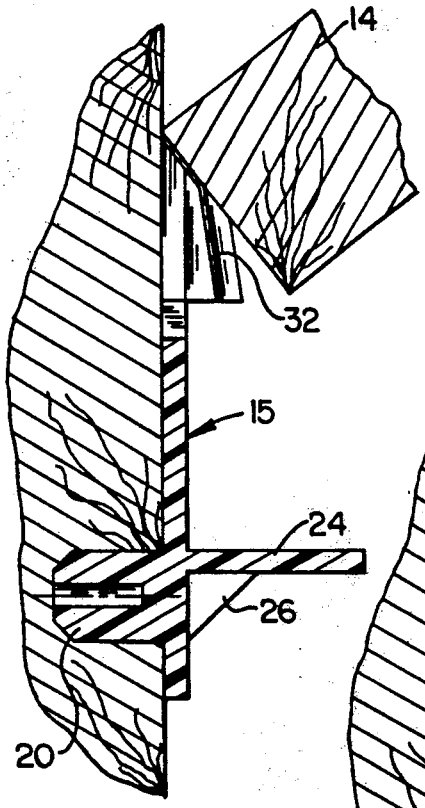
FIGS. 7a–7c illustrate various steps in which the shelf is inserted onto the support bracket.
Figure 7B:
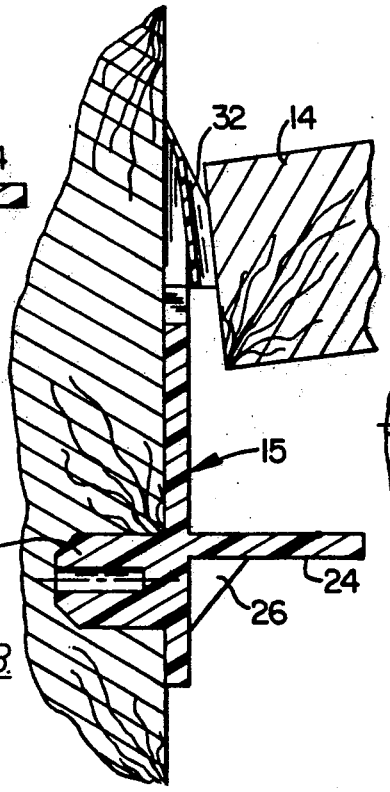
Figure 7C:
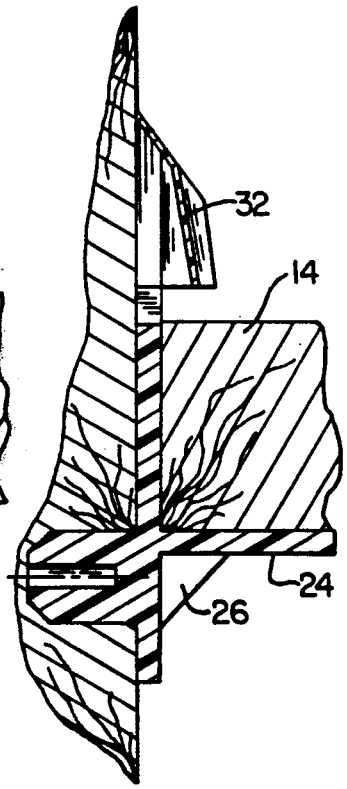

FIGS. 7*a*–7*c* represent steps depicting the sliding of a shelf onto the support bracket 10 and into a position in which the shelf is supported and retained by the bracket. As shown in FIG. 7*a*, the edge of the shelf is moved at an angle onto the flexible sheet hinge 50 and upper edges 38 of the flexural plates 32. As the shelf moves downward, the inner edges 34 move toward each other, and the plates 32 flatten into a more coplanar configuration with the body 15 (FIG. 7*b*). As the shelf 14 is lowered onto the shelf support 24, the flexural plates return to their original orientation. The lower shelf engaging edge 36 of the plate 32 engages the shelf 14 to retain the shelf in position and prevent upward raising movement. The support arms 30 provide rigid support through the upper body portion and prevents the limbs for from being forced apart as in other prior art support brackets.

The present invention offers benefits over other proposed support brackets. The flexible sheet hinge 50 not only provides greater support to the flexural plates 32, but also allows the flexural plates 32 to move toward each other and flatten into a more coplanar configuration as the shelf is moved. Additionally, in the present application, the flexural plates 32 do not create a biasing, twisting force on the upper body portion as the shelf is lowered. Thus, the support bracket 10 to can be manufactured having a more rigid upper body portion 1 6 as compared to some proposed support brackets in which members are adapted to twist and be forced apart to accommodate shelf insertion.

The forgoing embodiments are to be considered illustrative rather than restrictive of the invention and those modifications which come within the meaning and range of equivalent to the claims are to be included therein.

That which is claimed is:

1. A support bracket for attaching a shelf to walls comprising:

a substantially planar body having upper and lower body portions, said upper body portion including a pair of substantially parallel lateral edges extending upward from the lower body portion and being coplanar with said lower body portion, means for securing the body to a wall, a support projecting forward from the lower body portion opposite the wall securing means for supporting the edge of a shelf, and a flexural plate attached to each of said pair of parallel lateral edges and having an inner edge, an upper edge and a lower shelf engaging edge below said inner and parallel edges, and each flexural plate being of substantially similar dimension to the other and extending forwardly and inwardly from the lateral edge toward a medial portion of the upper body portion to form a gap between the inner edges of the plates that is about one-half the length of said lower shelf engaging edge, wherein upon pressure from a shelf edge lowered onto the upper edges of the flexural plates, the inner edges of the flexural plates move toward each other and the plates flatten into a more coplanar configuration with the body member and wherein the flexural plates return to their original orientation as the upper edge of the shelf passes the lower shelf engaging edges.

2. A support bracket according to claim 1 wherein said flexural plates are resiliently connected to the edges.

3. A support bracket according to claim 1 including a flexible sheet hinge connected to and extending between the inner edges.

4. A support bracket according to claim 3 wherein the flexible sheet hinge has a profile chosen from the group comprising V-shaped, semicircular, semihexagonal, semioctagonal and arcuate.

5. A support bracket according to claim 3 wherein each of said flexural plates includes an upper edge and wherein said flexible sheet hinge is connected to the upper edges and extends rearward and upward from the upper edges.

6. A support bracket according to claim 3 wherein said lateral edges of said upper portion remain substantially vertical during shelf insertion.

7. A support bracket according to claim 1 wherein said upper and lower body portions are formed from a polymeric material.

8. A support bracket according to claim 1 wherein the inner edges are defined by a pair of substantially rigid arm members.

9. A support bracket according to claim 1 wherein said means for securing the body member to a wall includes a post projecting rearward from the body portion for securing the shelf support to a wall.

10. A support bracket for attaching a shelf to walls comprising:

a substantially planar body member having upper and lower body portions, a said upper body portion including a pair of substantially rigid arm members extending upward from the lower body portion and being coplanar with said lower body portion, a support projecting forward from the lower body portion for supporting the edge of a shelf, a flexural plate flexibly connected to each arm member, each plate having an inner edge, a lower shelf engaging edge, and an upper edge being tapered rearward and upward from the inner edge to the arm member, each plate extending forwardly and inwardly from the arm members toward a medial portion of the upper body portion to form a gap between the inner edges of the plates, a flexible sheet hinge attached to the flexural plates and extending along the inner and upper edges of the plates, wherein upon pressure from a shelf edge lowered onto the upper edges of the flexure plates, the inner edges of the flexure plates move toward each other and the plates flatten into a more coplanar configuration with the body and wherein the flexural plates return to their original orientation as the upper edge of the shelf passes the lower shelf engaging edge.

11. A support bracket according to claim 10 wherein each flexural plate is of substantially similar configuration to each other, and the formed gap between the inner edges of the plates is about one-half the length of said lower shelf engaging edge.

12. A support bracket according to claim 10 wherein the flexible sheet hinge has a profile chosen from the group comprising V-shaped, semicircular, semihexagonal, semioctagonal and arcuate.

13. A support bracket according to claim 10 wherein the substantially rigid arm members remain substantially vertical during shelf insertion.

14. A support bracket according to claim 10 wherein said upper and lower body portions are formed from an injection molded polymeric material.

15. A support bracket according to claim 10 wherein said means for securing the body member to a wall includes a post projecting rearward from the lower body portion for securing the shelf support to a wall.

16. A support bracket according to claim 15 wherein said post is a fluted hollow cylinder.

17. A support bracket according to claim 10 wherein each of the flexure plates is configured in a trapezoid.

18. A support bracket according to claim 10 wherein the upper body portion includes a rectangular configured cut-out positioned below the lower shelf engaging edge.

19. A support bracket according to claim 10 at least one support brace supported by the lower body member and connected to the support.

* * * * *